US005966006A

United States Patent [19]

Migliavacca

[11] Patent Number: 5,966,006

[45] Date of Patent: Oct. 12, 1999

[54] VOLTAGE REGULATOR GENERATING A PREDETERMINED TEMPERATURE-STABLE VOLTAGE

[75] Inventor: Paolo Migliavacca, Grenoble, France

[73] Assignee: SGS-Thomson Microelectronic S.A., Saint Genis, France

[21] Appl. No.: 09/001,686

[22] Filed: Dec. 31, 1997

[30] Foreign Application Priority Data

Dec. 31, 1996 [FR] France ..... 96 16380

[51] Int. Cl.[6] ..... G05F 3/16

[52] U.S. Cl. ..... 323/315; 323/907

[58] Field of Search ..... 323/315, 316, 323/907

[56] References Cited

U.S. PATENT DOCUMENTS

| | | | |
|---|---|---|---|
| 4,491,780 | 1/1985 | Neidorff | 232/313 |
| 5,121,004 | 6/1992 | Kesler et al. | 307/454 |
| 5,404,096 | 4/1995 | Thiel | 323/312 |
| 5,432,432 | 7/1995 | Kimura | 323/313 |
| 5,446,368 | 8/1995 | Uscategui | 323/315 |
| 5,576,616 | 11/1996 | Ridgers | 323/314 |

*Primary Examiner*—Shawn Riley
*Attorney, Agent, or Firm*—Wolf, Greenfield & Sacks, P.C.

[57] ABSTRACT

A voltage regulator for powering a load with a predetermined temperature-stable voltage, including an output stage, a terminal of which provides a current to the load, at a reference voltage; and a current source including a first branch formed of transistors and of a first resistor connected in series between two supply terminals, and a second branch formed of transistors connected in series between the two supply terminals, the output stage including a bipolar transistor connected as a current mirror with a bipolar transistor of the second branch, and the two transistors of the current source are crossed.

37 Claims, 2 Drawing Sheets

VOLTAGE REGULATOR GENERATING A PREDETERMINED TEMPERATURE-STABLE VOLTAGE

BACKGROUND OF THE INVENTION

1. Field of the Invention

The present invention relates to a regulator for powering a load with a predetermined voltage, stable in temperature and independent from possible variations of a supply voltage of the regulator. The present invention more specifically applies to a series regulator which can operate with a low supply voltage, for example, on the order of 2.2 volts and relates, more specifically, to a regulator implemented in the form of a circuit integrating bipolar transistors and MOS transistors.

2. Discussion of the Related Art

FIG. 1 shows a diagram of a conventional series regulator.

The regulator generally includes an output stage 1 for supplying, on a terminal S, a temperature-compensated reference voltage Vref. Stage 1 is controlled by a current source 2 for providing a control current Ib, independent from possible variations of a supply voltage Vcc of the circuit. Voltage Vref is used to power a load Q, either directly, or via a resistive dividing bridge (not shown) connected between terminal S and the ground.

Stage 1 includes an assembly formed of two NPN-type bipolar transistors T1, T2 and of a resistor R1 for setting voltage Vref, by using the energy gap of silicon, independently from the temperature. Such an assembly is generally referred to as a "band gap" assembly. Transistor T1 is connected in series with a P-channel MOS transistor MP1 between a terminal E, receiving supply voltage Vcc, and the ground. The emitter of transistor T1 is connected to the ground and the source of transistor MP1 is connected to terminal E. Resistor R1 is connected in series with transistor T2 between terminal S and the ground. The emitter of transistor T2 is connected to the ground and connection node A of resistor R1 and the collector of transistor T2 is connected to the base of transistor T1. Terminal S is connected, via an N-channel MOS transistor MN2, to terminal E. The source of transistor MN2 is connected to terminal S and its gate is connected to the drain of transistor MP1 and to the collector of transistor T1.

The value of voltage Vref corresponds to the base-emitter voltage drop Vbe1 of transistor T1 plus the voltage drop in resistor R1 (Vbe1+I'.R1).

The current I' in resistor R1 is set by current source 2. This source 2 includes a first branch formed by a P-channel MOS transistor MP3, two NPN-type bipolar transistors T5, T3, and a resistor R3, connected in series between terminal E and the ground. A second branch includes a P-channel MOS transistor MP4 and two NPN-type bipolar transistors T6, T4, connected in series between terminal E and the ground. Transistor T4 is connected as a diode and as a current mirror on transistor T3, their bases being connected to the collector of transistor T4. Transistor MP3 is connected as a diode and as a current mirror on transistor MP4, their gates being connected to the drain of transistor MP3. Transistor MP1 is connected as a current mirror on transistor MP3, its gate being connected to the gate of transistor MP3. Transistor T6 is diode-connected and the bases of transistors T5 and T6 are connected to the collector of transistor T6. The function of transistors T5 and T6 is to limit the "Early" effect, as will be seen hereafter.

Transistor T2 of stage 1 is connected as a current mirror with transistor T4 of source 2, its base being connected to the base of transistor T4. Thus, neglecting the base currents, the collector current I of transistor T4 is, as a first approximation, equal to (Vbe4-Vbe3)/R3, where Vbe3 and Vbe4 represent the respective base-emitter voltages of transistors T3 and T4. This current I thus varies, like resistor R3, in a way directly proportional to temperature.

Voltage Vref, equal to Vbe1+I'.R1 (or I.R1), is thus temperature-compensated, since voltage Vbe1 varies in a way inversely proportional to temperature.

The operation of such a regulator is perfectly well known and will only be reviewed briefly. As a first approximation, a variation of supply voltage Vcc is compensated by a proportional variation of the on-state drain-source resistances of the MOS transistors. Indeed, the drain transistor MP4 is at a fixed potential corresponding to the sum of the base-emitter voltages of transistors T4 and T6. Thus, current I is, as a first approximation, maintained at a constant value according to resistance R3.

The approximation (I=[Vbe4-Vbe3]/R3) is only true for a low supply voltage Vcc of about 2.2 to 2.5 volts. Indeed, if voltage Vcc becomes higher, transistors T5 and T6, which introduce a collector-emitter voltage (Vce) in each branch to make the voltages Vce of the bipolar transistors and the drain-source voltages (Vds) of the MOS transistors negligible with respect to their respective "Early" voltages, are no longer sufficient. The "Early" voltages of the transistors depend on the technology used and are generally on the order of one hundred volts. When voltage Vcc becomes high, voltages Vce and Vds modify the collector currents of the bipolar transistors and the drain currents of the MOS transistors. In this case, the biasing currents of MOS transistor MP3, MP4, and MP1 are modified, which results in an increase of current I and, by this way, in an increase of voltage Vref.

As a specific example, assuming that transistors MP1, MP3, and MP4 have identical dimensions and exhibit a gate length of 12 $\mu$m for a gate width of 20 $\mu$m, voltage Vref set to approximately 1.2 volts increases by approximately 60 millivolts when voltage Vcc transits from approximately 2.5 to approximately 10 volts.

A conventional solution to reduce the variations of voltage Vref consists of increasing the gate lengths of transistors MP1, MP3, and MP4 to increase their respective drain-source resistances and thus reduce the voltages Vce of the bipolar transistors. A disadvantage of such a solution is that it is increases the size of the regulator implemented in an integrated circuit.

Further, it is not desirable to increase the number of assemblies that limit the "Early" effect (T5 and T6) since the base-emitter voltage drops introduced by transistors T5 and T6 in the branches of current source 2 increase the minimum supply voltage of the regulator.

SUMMARY OF THE INVENTION

The present invention aims at improving the stability, against variations of a supply voltage, of a voltage regulator for powering a load with a temperature-stable voltage.

The present invention also aims at increasing the supply voltage operating rang of the regulator.

The present invention also aims at providing such a regulator which is of small bulk and which can operate under a low supply voltage, of about 2.2 volts.

To achieve these and other objects, the present invention provides a voltage regulator for powering a load with a predetermined temperature-stable voltage, including an output stage, a terminal of which provides a current to the load, at a reference voltage; and a current source including a first branch formed of transistors and of a first resistor connected in series between the two supply terminals, and a second branch formed of transistors connected in series between the two supply terminals, the output stage including a bipolar transistor connected as a current mirror with a bipolar transistor of the second branch, in which the two transistors of the current source are crossed.

According to an embodiment of the present invention, the first branch is formed by a first MOS transistor, a first bipolar transistor, a second bipolar transistor and the first resistor and the second branch is formed a second MOS transistor, a third bipolar transistor and a fourth bipolar transistor; and the base of the fourth bipolar transistor is connected between the first and second bipolar transistors, the base of the second transistor being connected between the third and fourth bipolar transistors.

According to an embodiment of the present invention, the ratio between the product of the surface areas of the second and third bipolar transistors and the product of the surface areas of the first and fourth bipolar transistors is chosen so that the product of the natural logarithm of this ratio, multiplied by the "Early" voltage of the bipolar transistors, is substantially equally to the "Early" voltage of the MOS transistors.

According to an embodiment of the present invention, the output stage includes a third MOS transistor connected in series with a fifth bipolar transistor between the supply terminals, the third MOS transistor being connected as a current mirror with the first MOS transistor and a fourth MOS transistor connected in series with a second resistor, a terminal of which, on the side of the fourth MOS transistor, forms the output terminal, and with a sixth bipolar transistor between the supply terminals; the gate of the fourth MOS transistor being connected between the third MOS transistor and the fifth bipolar transistor, the base of which is connected between the second resistor and the sixth bipolar transistor connected as a current mirror with the second bipolar transistor.

According to an embodiment of the present invention, the bipolar transistors are all of the same type.

According to an embodiment of the present invention, the fourth MOS transistor is of a different type of channel than that of the three first MOS transistors.

According to an embodiment of the present invention, the bipolar transistors are of NPN type, and the fourth MOS transistor is an N-channel transistor.

According to an embodiment of the present invention, the bipolar transistors are of PNP type, and the fourth MOS transistor is a P-channel transistor.

The foregoing objects, features and advantages of the present invention, will be discussed in detail in the following non-limiting description of specific embodiments in connection with the accompanying drawings.

DETAILED DESCRIPTION

Figure 1:
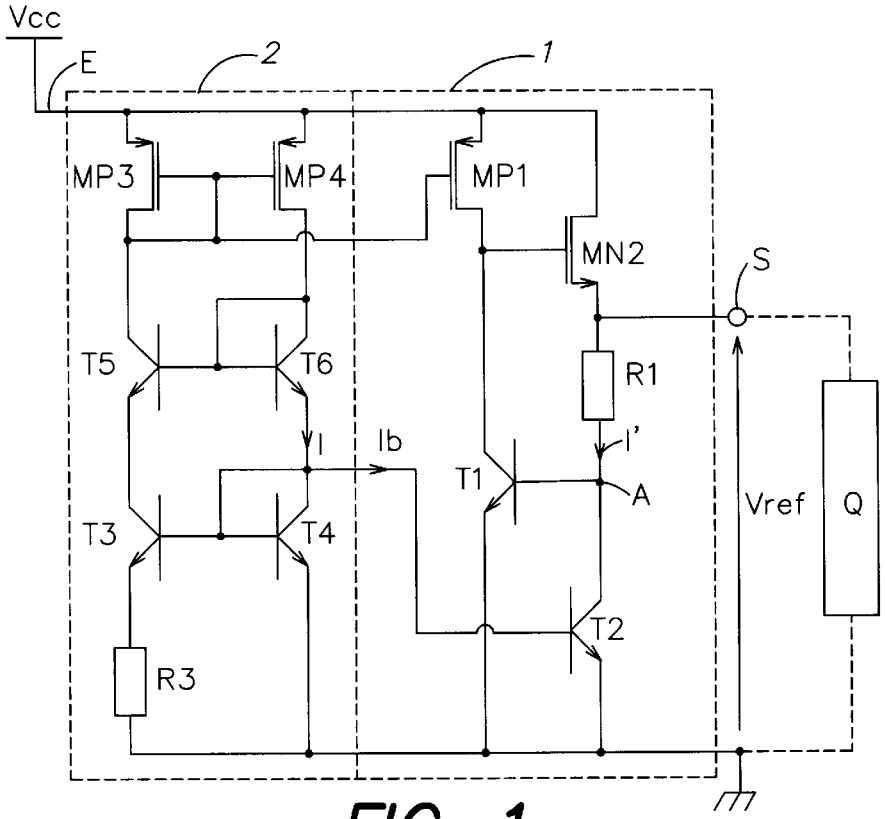
FIG. 1 (PRIOR ART)
FIG. 1, previously described, is meant to show the state of the art and the problem to solve.
Figure 2:
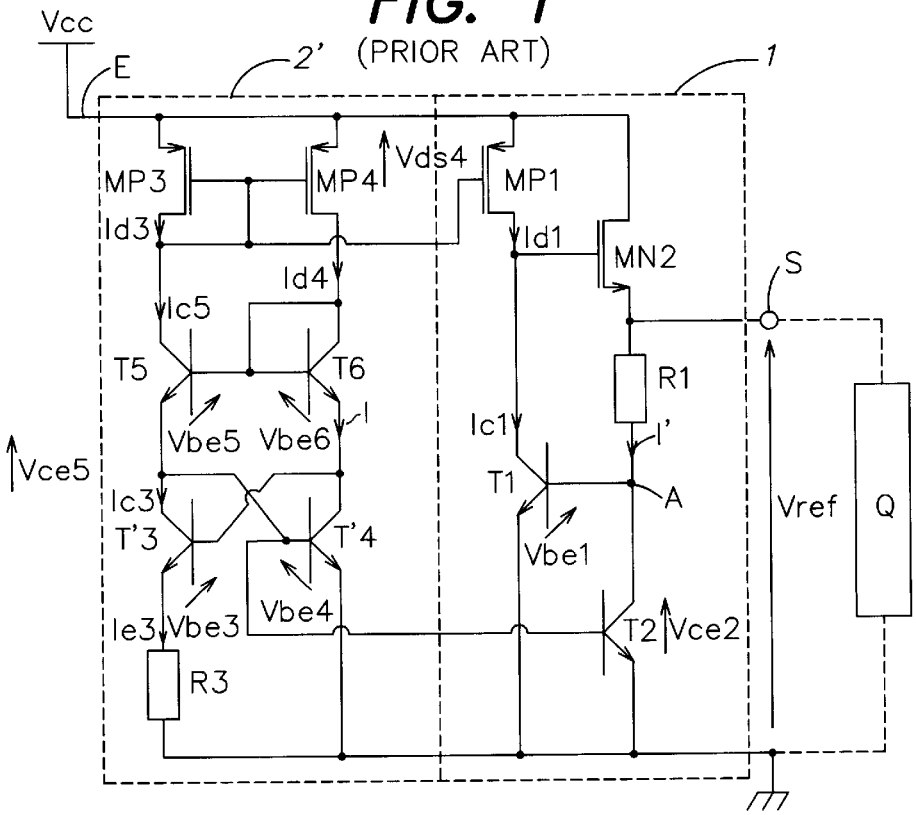
FIG. 2 shows an embodiment of a voltage regulator according to the present inventions and FIG. 3 shows an embodiment of a voltage regulator according to the present invention.
Figure 3:
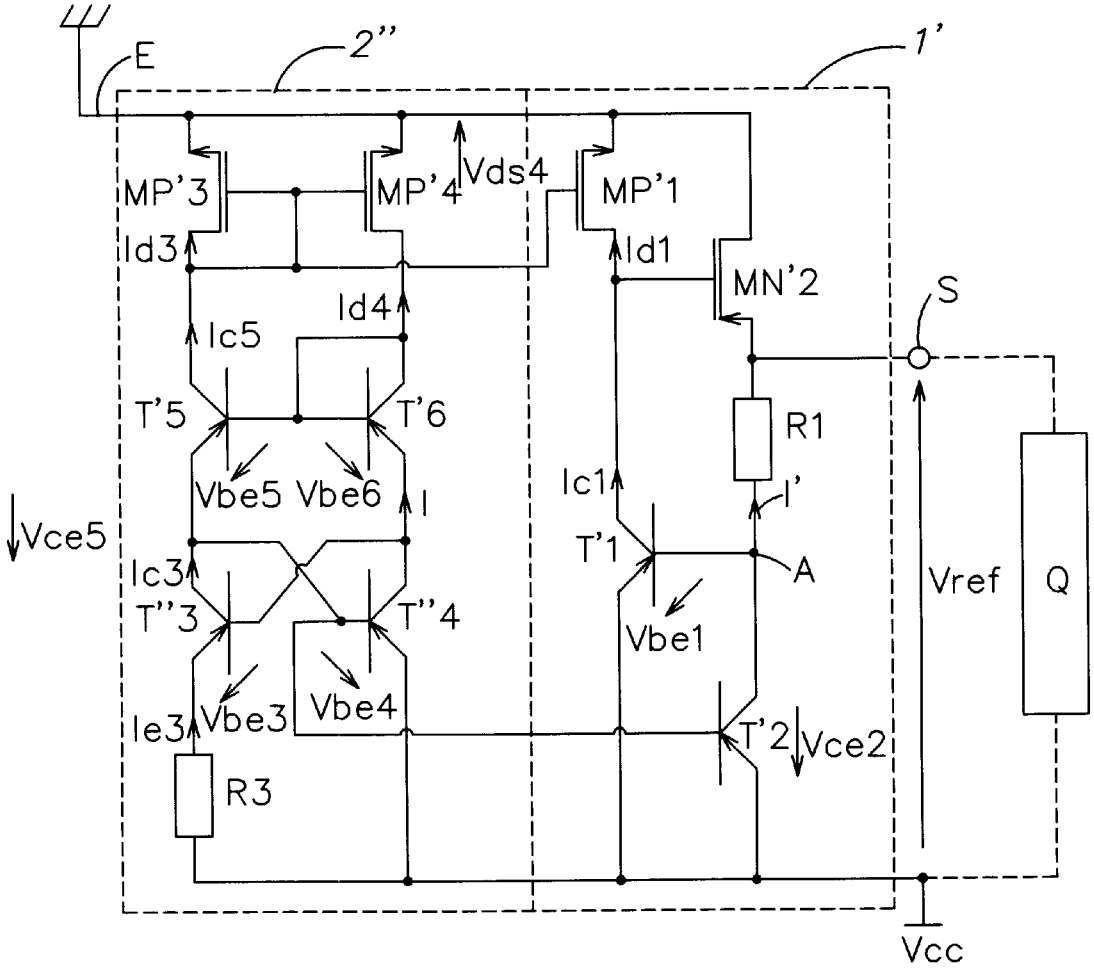

For clarity, the same elements have been referred to with the same reference numbers in FIG. 1, 2, and 3.

A regulator according to the present invention includes an output stage 1, a terminal S of which is meant to power a load Q, either directly, or via a resistive dividing bridge (no shown) provided between terminal S and the ground, with a temperature-stable voltage. The constitution of stage 1 is similar to that of a conventional regulator such as shown in FIG. 1. Stage 1 thus includes two NPN-type bipolar transistors T1, T2, a resistor R1, a P-channel MOS transistor MP1 and an N-channel MOS transistor MN2, conventionally associated.

Stage 1 is controlled by a current source 2', the function of which is to m e a voltage Vref, between terminal S and the ground, independent of possible variations of the supply voltage Vcc of the circuit.

Source 2' includes a first branch formed by a P-channel MOS transistor MP3, connected as a diode and in series with two NPN-type bipolar transistors T5 and T'3 and a resistor R3, between a terminal E providing voltage Vcc and the ground. A second branch is formed by P-channel MOS transistor MP4 in series with two NPN-type bipolar transistors T6 and T'4 between terminal E and the ground. As noted previously, transistor T6 is connected as a diode, transistor MP1 of stage 1 is connected as a current mirror with transistor MP3, transistor T2 is connected as a current mirror with transistor T'4, and the base of transistor T'3 is connected to the collector of transistor T'4.

A characteristic of the present invention is that transistor T'4 is not diode-connected as in a conventional circuit, but that its base is connected to the collector of transistor T'3. Transistor T'4 is thus no longer connected as a current mirror on transistor T'3. Such an assembly results, according to the present invention, in obtaining a "crossed" current source for controlling output stage 1.

Such a crossed current source creates a loop of base-emitter voltages (Vbe) of the bipolar transistors of current source 2', independent from the collector-emitter voltage (Vce) of these bipolar transistors.

The effects of such a characteristic will become more apparent from the following relations in which the different transistors are identified by an index corresponding to their reference number.

The collector current Ic of a bipolar transistor is given by the relation:

$$Ic=S.I_0\exp[(Vbe/VT).(1Vce/Vaf))],$$

where S represents the transistor surface area, $I_0$ and VT are constants, and where Vaf is the "Early" voltage of a bipolar transistor, which is the same for all bipolar transistors of the same integrated circuit.

When voltage Vce is negligible with respect to voltage Vaf, term 1+(Vce/Vaf) is substantially equal to 1 and can thus be neglected. This happens in a conventional assembly when voltage Vcc remains low.

According to the present invention, in the crossed source:

$$Vbe_6Vbe_3Ie_3.R_3=Vbe_5Vbe_4,$$

where $Ie_3$ is the emitter current of transistor T'3.

By combining the above equation with the expression of the collector current of the different transistors, and neglecting the base current of transistor T'3 ($Ic_3 \approx Ie_3$), one obtains:

$$Ic_3=(VT/R3).In\ \{(S_6S_3/S_5S_4)/(1+Vce_5/Vaf)\}.$$

The drain current Id of a MOS transistor is given by the relation:

$$Id=K.(W/L).(Vgs-Vt)^2.[1(Vds/Va)],$$

where K is a constant, Vt represents the threshold voltage of a MOS transistor, Va represents the "Early" voltage of a MOS transistor, and Vgs and Vds represent, respectively, the gate-source and drain-source voltages of the transistor.

When a MOS transistor is connected as a diode (transistor MP3), its voltage Vds is negligible with respect to voltage Va and the term 1+(Vds/Va) of the preceding expression can be neglected.

Since current $Id_3$ is equal to current $Ic_5$, current $Ic_3$ can be written, neglecting the base current of transistor T5, as:

$$Ic_3=(VT/R_3).[In(KS)-(Vce_5/Vaf)], \text{ where } KS=S_6S_3/S_5S_4.$$

By writing $Vce_5$ and $Vds_3$ as functions of voltage Vcc, current $Id_4$ can be written, considering that the bipolar transistors have equal voltages Vbe and that the P-channel MOS transistors have equal voltages Vgs, as:

$$Id_4 = \frac{VT}{R3}\cdot\ln(KS)\cdot\left(1+\frac{Vcc-2Vbe}{Va}-\frac{Vcc-Vgs-Vbe}{Vaf\cdot\ln(KS)}+\epsilon\right),$$

where $\epsilon$ is a second order term.

For current $Id_4$ to be independent from voltage Vcc, the following condition just has to be met:

$$Va=Vaf.In\ [S_6S_3/S_5S_4)].$$

This condition applies for MOS transistors of small size, having for example gate length 1=12 $\mu$m.

According to the present invention, current I is independent from current $Ic_3$ which itself depends on voltage $Vce_5$ of transistor T5, and thus on voltage Vcc. Similarly, current I is made independent from voltage $Vds_4$ which varies with the supply voltage.

Since current $Id_1$ of transistor MP1 has the same behavior as current $Id_4$ (transistors MP4 and MP1 are connected as a current mirror), currents $Ic_1$ and I' ($Ic_2$) are independent from voltage Vcc.

Since voltage $Vce_2$ is equal to voltage $Vbe_1$, voltage $Vce_2$ (lower than 1 volt) is negligible with respect to "Early" voltage Vaf (of around 100 volts) and is thus unresponsive to the variations of voltage Vcc.

Accordingly, voltage Vref is substantially independent from supply voltage Vcc.

As a specific example, if the technology used leads to "Early" voltages of around 106 volts for the bipolar transistors (Vaf) and of around 150 volts for the MOS transistors (Va), the surface area condition is met, for example, with a transistor T'3 having a surface area four times larger than that of transistors T'4, T5, and T6.

Referring again to the specific example described in relation with FIG. 1, the variations of reference voltage Vref are then on the order of 2 millivolts in a variation range included between approximately 2.5 volts and 10 volts of supply voltage Vcc, the MOS transistors having a gate length of 12 $\mu$m.

An advantage of the present invention is that it substantially improves the stability of the voltage provided by a regulator, while maintaining a low minimum supply voltage and a small size. Indeed, the increase by a factor 4 of the surface area of transistor T'3 is negligible with respect to the surface area increase of the MOS transistors which would be necessary to obtain the same result conventionally. Indeed, with the conventional solution, the gate length of the MOS transistors should increase from about 12 $\mu$m to about 500 $\mu$m.

Of course, the present invention is likely to have various alterations, modifications, and improvements which will readily occur to those skilled in the art. In particular, the sizes given as examples can be modified according to the application for which the regulator is meant. Further, although reference has been made in the foregoing description to a positive voltage regulator, the present invention can also be used to provide a negative voltage regulator, as shown in FIG. 3. It is enough, for this purpose, to invert the supply voltage and to replace the P-channel and, N-channel, MOS transistors with N-channel, and P-channel, MOS transistors, and, respective to replace the NPN-type bipolar transistors with PNP-type bipolar transistors.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A voltage regulator for powering a load with a predetermined temperature-stable voltage, including:

an output stage, an output terminal of which provides a current to the load, at a reference voltage; and a current source including a first branch formed of a first MOS transistor, a first bipolar transistor, a second bipolar transistor and a first resistor connected in series between two supply terminals, and a second branch formed of a second MOS transistor, a third bipolar transistor and a fourth bipolar transistor connected in series between the two supply terminals, the output stage including a fifth bipolar transistor connected as a current mirror with the fourth bipolar transistor, wherein a base of the fourth bipolar transistor is connected between the first and second bipolar transistors, and a base of the second bipolar transistor is connected between the third and fourth bipolar transistors.

2. The voltage regulator of claim 1, wherein a ratio between a product of surface areas of the second and third bipolar transistors and a product of surface areas of the first and fourth bipolar transistors is chosen so that a natural logarithm of the ratio multiplied by an "Early" voltage of the bipolar transistors is substantially equal to an "Early" voltage of the MOS transistors.

3. The voltage regulator of claim 1, wherein the output stage includes:

a third MOS transistor connected in series with a sixth bipolar transistor between the supply terminals, the third MOS transistor being connected as a current mirror with the first MOS transistor; and a fourth MOS transistor connected in series with a second resistor and the fifth bipolar transistor between the supply terminals, the output terminal formed between the fourth MOS transistor and the second resistor, wherein a gate of the fourth MOS transistor is connected between the third MOS transistor and the sixth bipolar transistor, and a base of the sixth bipolar transistor is connected between the second resistor and the fifth bipolar transistor.

4. The voltage regulator of claim 3, wherein each of the bipolar transistors are of a first type.

5. The voltage regulator of claim 4, wherein the fourth MOS transistor is of a different type than that of the first, second, and third MOS transistors.

6. The voltage regulator of claim 5, wherein each of the bipolar transistors are of an NPN type.

7. The voltage regulator of claim 5, wherein each of the bipolar transistors are of a PNP type.

8. The voltage regulator of claim 6, wherein the fourth MOS transistor is an N-channel transistor.

9. The voltage regulator of claim 7, wherein the fourth MOS transistor is a P-channel transistor.

10. The circuit of claim 1 implemented as an integrated semiconductor circuit.

11. A circuit for generating a predetermined temperature-stable output voltage at an output terminal, wherein the output voltage generated is substantially independent of variations of a supply voltage, the circuit comprising:

a current generating circuit including:

a first branch formed by a plurality of transistors, including a first transistor, and a first resistor connected in series between a first supply terminal and a second supply terminal;

a second branch formed by a plurality of transistors, including a second transistor, connected in series between the first supply terminal and the second supply terminal; and an output circuit including:

the output terminal; and a third transistor connected between the output terminal and the second supply terminal, wherein a current node of the first transistor is connected to a control node of the second transistor, and a current node of the second transistor is connected to a control node of the first transistor, and wherein a control node of the third transistor is connected to the current node of the first transistor.

12. The circuit of claim 11, wherein the control node of the third transistor is connected to the second transistor of the second branch as a current mirror.

13. The circuit of claim 11, wherein the first branch is formed by a fourth transistor, a fifth transistor, the first transistor, and the first resistor connected in series, respectively, and the second branch is formed by a sixth transistor, a seventh transistor, and the second transistor connected in series, respectively, wherein the current node of the first transistor is between the first and fifth transistors, and the current node of the second transistor is between the second and seventh transistors.

14. The circuit of claim 13, wherein the first, second, fifth, and seventh transistors all have a first "Early" voltage, and the fourth and sixth transistors have a second "Early" voltage, and wherein a ratio between a product of surface areas of the first and seventh transistors and a product of surface areas of the second and fifth transistors is chosen so that a natural logarithm of the ratio multiplied by the first "Early" voltage is substantially equal to the second "Early" voltage.

15. The circuit of claim 13, the output circuit further including:

an eighth transistor connected in series with a ninth transistor between the first and second supply terminals, the eighth transistor being connected as a current mirror with the fourth transistor of the first branch; and a tenth transistor connected in series with a second resistor and the third transistor, respectively, between the first and second supply terminals, the output node of the output circuit being between the tenth transistor and the second resistor, wherein a control node of the tenth transistor is connected between the eighth transistor and the ninth transistor, and a control node of the ninth transistor is connected between the second resistor and the third transistor.

16. The circuit of claim 11 implemented as an integrated semiconductor circuit.

17. The circuit of claim 11, wherein the first, second, and third transistor are bipolar transistors.

18. The circuit of claim 13, wherein the first, second, third, fifth, and seventh transistors are bipolar transistors, and the fourth and sixth transistors are MOS transistors.

19. The circuit of claim 15, wherein the first, second, third, fifth, seventh, and ninth transistors are bipolar transistors, and the fourth, sixth, eighth, and tenth transistors are MOS transistors.

20. The circuit of claim 18, wherein the current generating circuit includes connecting means for creating a circuit loop of base-emitter voltages of the bipolar transistors of the first and second branches independent from collector-emitter voltages of the bipolar transistors of the first and second branches.

21. The voltage regulator of claim 1, wherein the collector of the fourth transistor is between the third and fourth bipolar transistors such that the base of the second transistor is connected to the collector of the fourth transistor.

22. The voltage regulator of claim 1, wherein the collector of the second transistor is between the first and second bipolar transistors such that the base of the fourth transistor is connected to the collector of the second transistor.

23. The circuit of claim 12, wherein the first and second transistors are bipolar transistors.

24. The circuit of claim 23, wherein the control node of the second transistor is a base of the second transistor, and the current node of the first transistor is a collector of the first transistor, such that the base of the second transistor and the control node of the third transistor are connected to the collector of the second transistor.

25. The circuit of claim 23, wherein the control node of the first transistor is a base of the first transistor, and the current node of the second transistor is a collector of the second transistor, such that the base of the first transistor is connected to the collector of the second transistor.

26. The voltage regulator of claim 1, wherein each of the bipolar transistors are of a first type.

27. The voltage regulator of claim 26, wherein each of the bipolar transistors are of an NPN type.

28. The voltage regulator of claim 26, wherein each of the bipolar transistors are of a PNP type.

29. The circuit of claim 18, wherein each of the bipolar transistors are of a first type.

30. The circuit of claim 29, wherein each of the bipolar transistors are of an NPN type.

31. The circuit of claim 29, wherein each of the bipolar transistors are of a PNP type.

32. The circuit of claim 19, wherein each of the bipolar transistors are of a first type.

33. The circuit of claim 32, wherein the tenth transistor is of a different type than a type of the fourth, sixth, and eighth transistors.

34. The circuit of claim 33, wherein each of the bipolar transistors are of an NPN type.

35. The circuit of claim 33, wherein each of the bipolar transistors are of a PNP type.

36. The circuit of claim 34, wherein the tenth transistor is an N-channel MOS transistor.

37. The circuit of claim 35, wherein the tenth transistor is a P-channel MOS transistor.

* * * * *